US005811743A

United States Patent [19]

Kohara et al.

[11] Patent Number: 5,811,743

[45] Date of Patent: Sep. 22, 1998

[54] VIBRATION CONTROL APPARATUS FOR ELEVATOR

[75] Inventors: Hideya Kohara, Tokyo; Shigeo Nakagaki, Saitamaken; Tadashi Shudo, Tokyo; Yukihiko Kazao, Kanagawa-ken, all of Japan

[73] Assignee: Kabushiki Kaisha Toshiba, Kawasaki, Japan

[21] Appl. No.: 424,547

[22] PCT Filed: Oct. 7, 1993

[86] PCT No.: PCT/JP93/01447

§ 371 Date: Aug. 3, 1995

§ 102(e) Date: Aug. 3, 1995

[87] PCT Pub. No.: WO95/09801

PCT Pub. Date: Apr. 13, 1995

[51] Int. Cl.[6] ..... B66B 1/34; B66B 3/00

[52] U.S. Cl. ..... 187/393; 187/292

[58] Field of Search ..... 187/391, 393, 187/292, 409, 410

[56] References Cited

U.S. PATENT DOCUMENTS

| | | | |
|---|---|---|---|
| 5,271,133 | 12/1993 | Dam et al. | 29/25.35 |
| 5,281,899 | 1/1994 | Culp | 381/116 |
| 5,294,757 | 3/1994 | Skalski et al. | 187/115 |
| 5,368,132 | 11/1994 | Howell et al. | 187/393 |

FOREIGN PATENT DOCUMENTS

| | | |
|---|---|---|
| 60-57030 | 4/1985 | Japan . |
| 2-21044 | 1/1990 | Japan . |
| 3-115076 | 5/1991 | Japan . |
| 3-39952 | 6/1991 | Japan . |
| 2 238 404 | 5/1991 | United Kingdom . |

*Primary Examiner*—Robert Nappi
*Attorney, Agent, or Firm*—Foley & Lardner

[57] ABSTRACT

A passenger car of an elevator is transversely vibrated when it is hoisted up or down due to curves in guide rails and level differences at joints of the guide rails. An elevator vibration control apparatus of this invention employs a vibration or displacement sensor attached to a passenger car chamber to detect such transverse vibration of the passenger car. A controller calculates an operation quantity of an actuator to cancel the detected vibration of the passenger car. According to the calculated operation quantity, a servomotor is driven to displace the passenger car in a direction to cancel the transverse vibration and suppress force applied to the passenger car. As a result, the transverse vibration of the passenger car is reduced, and comfortableness of riding in the passenger car is improved.

12 Claims, 16 Drawing Sheets

Z : DISPLACEMENT
V : VOLTAGE (a) TRANSLATION MODE (b) ROTATION MODE

VIBRATION CONTROL APPARATUS FOR ELEVATOR

TECHNICAL FIELD

This invention relates to a vibration control apparatus for an elevator.

BACKGROUND ART

FIG. 16 shows a passenger car of an ordinary elevator that is hoisted up or down along guide rails installed in an elevator passage of a high-rise building. The elevator passage 1 has sidewalls along which the guide rails 2 are vertically installed. The passenger car 4 is arranged between the guide rails 2 and is hoisted up or down by hoist cables 3. The passenger car 4 consists of a passenger car frame 5 and a passenger car chamber 6 supported by the passenger car frame 5. Four guide units 7 are arranged on the top and bottom of the passenger car frame 5. As shown in FIG. 17, the guide unit 7 has a guide base 8*a* fixed to the passenger car frame 5, a lever 8*b* having an end rotatably attached to the guide base 8*a*, a guide roller 8*c* rotatably attached to the other end of the lever 8*b*, a rod 8*d* having an end fixed to the guide base 8*a*, and a presser spring 8*e* arranged between the lever 8*b* and the rod 8*d*, to suppress a displacement of the guide roller 8*c*. The guide roller 8*c* is in contact with the side and end faces of the guide rail 2 and rolls along the guide rail 2.

As shown in FIG. 16, floor support frames 9 are laid on the bottom of the passenger car frame 5. Rubber dampers 10 are arranged between the floor support frames 9 and the bottom of the passenger car chamber 6, to support the passenger car chamber 6.

Curves and installation errors in the guide rails 2 and level differences at joints of the guide rails may vibrate the passenger car 4 of the conventional elevator. The vibration is transmitted to persons in the passenger car 4, to make them uncomfortable. The rubber dampers 10 absorb such vibration and improve comfortableness in riding the elevator.

The conventional elevator, however, is incapable of completely eliminating the vibration caused by the guide rails. Generally, vibration due to the guide rails increases as the running speed of the elevator increases. When the speed of the passenger car of the elevator exceeds a given value, vibration of the passenger car due to the guide rails exceeds an allowable range, to cause uncomfortableness. When the speed of the passenger car reaches a certain level, a vibration frequency due to forcible displacements by the curves in the guide rails agrees with the natural frequency of the passenger car, to cause a resonance. The resonance strongly vibrates the passenger car, to drastically deteriorate comfortableness in the passenger car.

DISCLOSURE OF INVENTION

To solve the problems of the prior art mentioned above, an object of this invention is to provide a vibration control apparatus for an elevator, for attenuating vibration of a passenger car of the elevator by forcibly displacing the passenger car in a direction to attenuate the vibration, or by employing a weight to produce inertial force to attenuate the vibration, thereby improving comfortableness in the passenger car.

In order to accomplish the object, the invention according to a first embodiment described in claim 1 provides a vibration control apparatus for an elevator having guide rails along an elevator passage and guide units on the top and bottom of a passenger car of the elevator. The guide unit has a rocking lever, a guide roller rotatably attached to the lever, and a spring to press the guide roller against the guide rail so that the guide roller may roll along the guide rail. The vibration control apparatus has an actuator made of a multilayer piezoelectric element disposed between the spring and guide roller of one of the guide units, to adjust a transverse displacement of the guide roller, a vibration sensor installed on the passenger car, to detect transverse vibration acceleration, and a controller for applying a voltage to the piezoelectric element to displace the actuator in a direction to cancel the transverse vibration acceleration of the passenger car detected by the vibration sensor.

The invention according to a second embodiment is based on the vibration control apparatus of the first embodiment. Each of the top and bottom guide units is provided with the actuator, and the top and bottom actuators are controlled by respective controllers. The vibration sensor is installed on each of the top and bottom of the passenger car, to detect transverse vibration acceleration at the top and bottom of the passenger car. The vibration sensors provide the controllers with signals representing detected transverse vibration acceleration.

The invention according to a third embodiment provides a vibration control apparatus for an elevator having guide rails along an elevator passage and guide units on the top and bottom of a passenger car of the elevator. The guide unit has a rocking lever, a guide roller rotatably attached to the lever, and a spring to press the guide roller against the guide rail so that the guide roller may roll along the guide rail. One of the top and bottom of the passenger car is provided with a servomotor, a translation mechanism driven by the servomotor, for converting rotational motion into linear motion, a weight linearly horizontally moved by the translation mechanism, a vibration sensor for detecting transverse vibration of the passenger car, and a controller for driving the servomotor in response to a signal from the vibration sensor, to linearly horizontally move the weight to produce inertial force in a direction to cancel the transverse vibration of the passenger car.

The invention according to a fourth embodiment is based on the vibration control apparatus of the third embodiment. Each of the top and bottom of the passenger car is provided with a servomotor, a translation mechanism driven by the servomotor, for converting rotation motion into linear motion, a weight linearly horizontally moved by the translation mechanism, a vibration sensor for detecting vibration of the passenger car, and a controller for driving the servomotor in response to a signal from the vibration sensor, to linearly horizontally move the weight to produce inertial force in a direction to cancel the transverse vibration of the passenger car.

The invention according to fifth embodiment provides a vibration control apparatus for an elevator having guide rails along an elevator passage and guide units on the top and bottom of a passenger car of the elevator. The guide unit has a rocking lever, a guide roller rotatably attached to the lever, and a spring to press the guide roller against the guide rail so that the guide roller may roll along the guide rail. One of the top and bottom of the passenger car is provided with a weight, a translation mechanism for linearly horizontally move the weight, a servomotor for driving the translation mechanism, a displacement detector for detecting a transverse displacement of the guide roller, an operation unit for calculating a driving quantity of the servomotor according to a signal from the displacement detector, to let the translation mechanism horizontally move the weight for a distance to attenuate transverse vibration of the passenger car caused by the transverse displacement of the guide roller, and a controller for driving the servomotor according to the driving quantity calculated by the operation unit.

The invention according to a sixth embodiment is based on the vibration control apparatus of the fifth embodiment. Each of the top and bottom of the passenger car is provided with a weight, a translation mechanism for linearly horizontally move the weight, a servomotor for driving the translation mechanism, a displacement detector for detecting a transverse displacement of the guide roller, an operation unit for calculating a driving quantity of the servomotor according to a signal from the displacement detector, to let the translation mechanism horizontally move the weight for a distance to attenuate transverse vibration of the passenger car caused by the transverse displacement of the guide roller, and a controller for driving the servomotor according to the driving quantity calculated by the operation unit.

The invention according to a seventh embodiment is based on the vibration control apparatus of the fifth or sixth embodiment. Two displacement detectors are arranged on left and right sides to face each other. An operation device provides the operation unit with a weighted average of displacement signals from the two displacement detectors.

The invention according to an eighth embodiment is based on the vibration control apparatus of any one of the fifth through seventh embodiments. A noncontact-type displacement detector is used to detect a displacement of the passenger car relative to the guide rail.

The invention according to a ninth embodiment is based on the vibration control apparatus of any one of the fifth through seventh embodiments. A contact-type displacement detector is attached to the passenger car, to detect a transverse displacement of the guide roller when the guide roller rolls along the guide rail and provide a signal representing a transverse displacement of the passenger car.

According to the elevator vibration control apparatus of the invention of the first embodiment, the vibration sensor attached to the passenger car detects transverse vibration of the passenger car caused by curves in the guide rails or level differences at joints of the guide rails when the passenger car is hoisted up or down. The controller calculates a control quantity of the actuator necessary to cancel the vibration acceleration of the passenger car and provides the actuator with the calculated control quantity. The multilayer piezoelectric element of the actuator is displaced in response to the control quantity, to displace the passenger car in a direction to attenuate the transverse vibration of the passenger car. As a result, force applied to the passenger car is suppressed, the transverse vibration of the passenger car is reduced, and comfortableness of riding in the passenger car is improved.

According to the elevator vibration control apparatus of the second embodiment, the vibration sensors arranged on the top and bottom of the passenger car detect transverse vibration at the top and bottom of the passenger car. The top and bottom controllers calculate control quantities of the top and bottom actuators necessary to cancel vibration acceleration at the top and bottom of the passenger car, and provide the top and bottom actuators with the calculated control quantities. The multilayer piezoelectric elements of the top and bottom actuators are displaced according to the control quantities, to displace the top and bottom of the passenger car in directions to attenuate transverse vibration at the top and bottom of the passenger car. As a result, force applied to the passenger car is suppressed, the transverse vibration of the passenger car is more effectively reduced, and comfortableness of riding in the passenger car is improved.

According to the elevator vibration control apparatus of the third embodiment, the vibration sensor detects transverse vibration of the passenger car caused by curves in the guide rails or level differences at joints of the guide rails when the passenger car is hoisted up or down. The controller processes a signal from the vibration sensor and drives the servomotor to let the translation mechanism linearly horizontally move the weight to produce inertial force in a direction to attenuate the transverse vibration of the passenger car. In this way, the translation mechanism moves the weight to produce the inertial force that attenuates the transverse vibration of the passenger car. As a result, the transverse vibration of the passenger car is reduced, and comfortableness of riding in the passenger car is improved.

According to the elevator vibration control apparatus of the fourth embodiment, the vibration sensors arranged on the top and bottom of the passenger car detect transverse vibration at the top and bottom of the passenger car. The top and bottom controllers process signals from the top and bottom vibration sensors and drive the servomotors to let the top and bottom translation mechanisms linearly horizontally move the top and bottom weights to produce inertial force in a direction to attenuate the transverse vibration at the top and bottom of the passenger car. In this way, the inertial force that attenuates the transverse vibration at the top and bottom of the passenger car is applied to the top and bottom of the passenger car. As a result, the transverse vibration of the passenger car is more effectively reduced, and comfortableness of riding in the passenger car is improved.

According to the elevator vibration control apparatus of the fifth embodiment, the displacement detector detects a displacement of the passenger car due to transverse vibration of the passenger car caused by curves in the guide rails or level differences at joints of the guide rails when the passenger car is hoisted up or down. According to a signal from the displacement detector, the operation unit calculates a driving quantity of the servomotor to let the translation mechanism horizontally move the weight for a distance to attenuate the transverse vibration of the passenger car due to the transverse displacement of the guide roller. According to the driving quantity calculated by the operation unit, the controller drives the servomotor. In this way, the translation mechanism moves the weight to produce the inertial force that attenuates the transverse vibration of the passenger car, and the inertial force is applied to the passenger car. As a result, the transverse vibration of the passenger car is reduced, and comfortableness of riding in the passenger car is improved.

According to the elevator vibration control apparatus of the sixth embodiment, the displacement detectors arranged on the top and bottom of the passenger car provide signals. The top and bottom operation units calculate driving quantities of the top and bottom servomotors to let the top and bottom translation mechanisms horizontally move the top and bottom weights for a distance to attenuate transverse vibration at the top and bottom of the passenger car due to transverse displacements of the guide rollers. According to the driving quantities calculated by the top and bottom operations units, the top and bottom controllers drive the top and bottom servomotors. In this way, the top and bottom translation mechanisms move the respective weights to produce the inertial force that attenuates the transverse vibration at the top and bottom of the passenger car, and the inertial force is applied to the passenger car. As a result, the transverse vibration at the top and bottom of the passenger car is reduced, and comfortableness of riding in the passenger car is improved.

According to the elevator vibration control apparatus of the seventh embodiment that is based on the fifth or sixth embodiment, the two displacement detectors horizontally face each other, and the operation device calculates a weighted average of displacement signals from the two displacement detectors and provides the operation unit with the weighted average, to more correctly detect a transverse displacement of the passenger car. The detected displacement is used to let the translation mechanism correctly control the movement of the weight. As a result, the transverse vibration of the passenger car is effectively attenuated, and comfortableness of riding in the passenger car is improved.

According to the elevator vibration control apparatus of the eighth embodiment that is based on any one of fifth through seventh embodiments, the noncontact-type displacement detector is used to detect a transverse displacement of the passenger car relative to the guide rail.

According to the elevator vibration control apparatus of the invention of claim 9 that is based on any one of fifth through seventh embodiment, the contact-type displacement detector is attached to the passenger car, to detect a transverse displacement when the guide rollers roll along the guide rails, and provide a signal representing a transverse displacement of the passenger car.

BEST MODE FOR CARRYING OUT THE INVENTION

Figure 1:
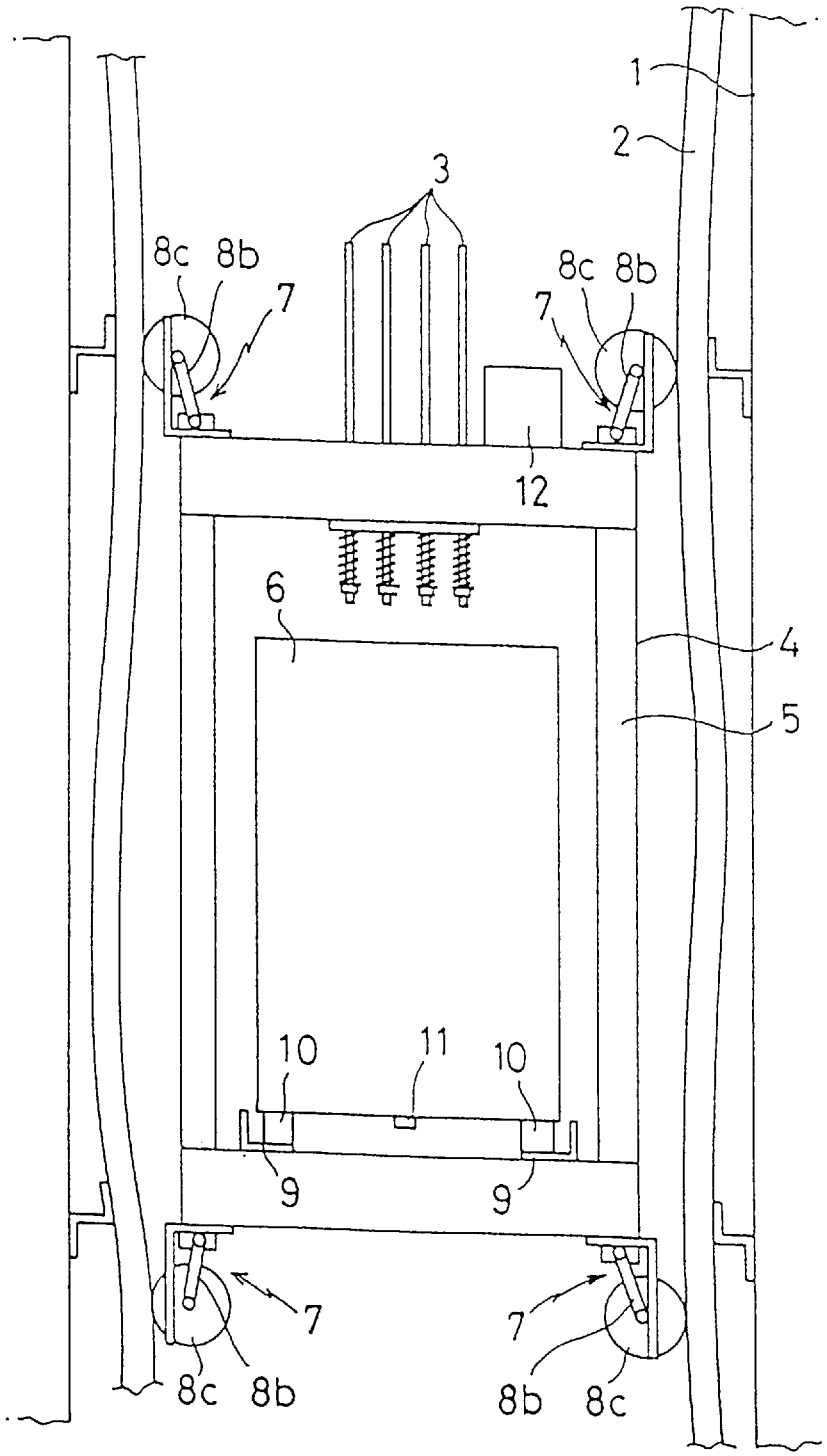
FIG. 1 is a schematic view showing a first embodiment of the invention.
Figure 16:
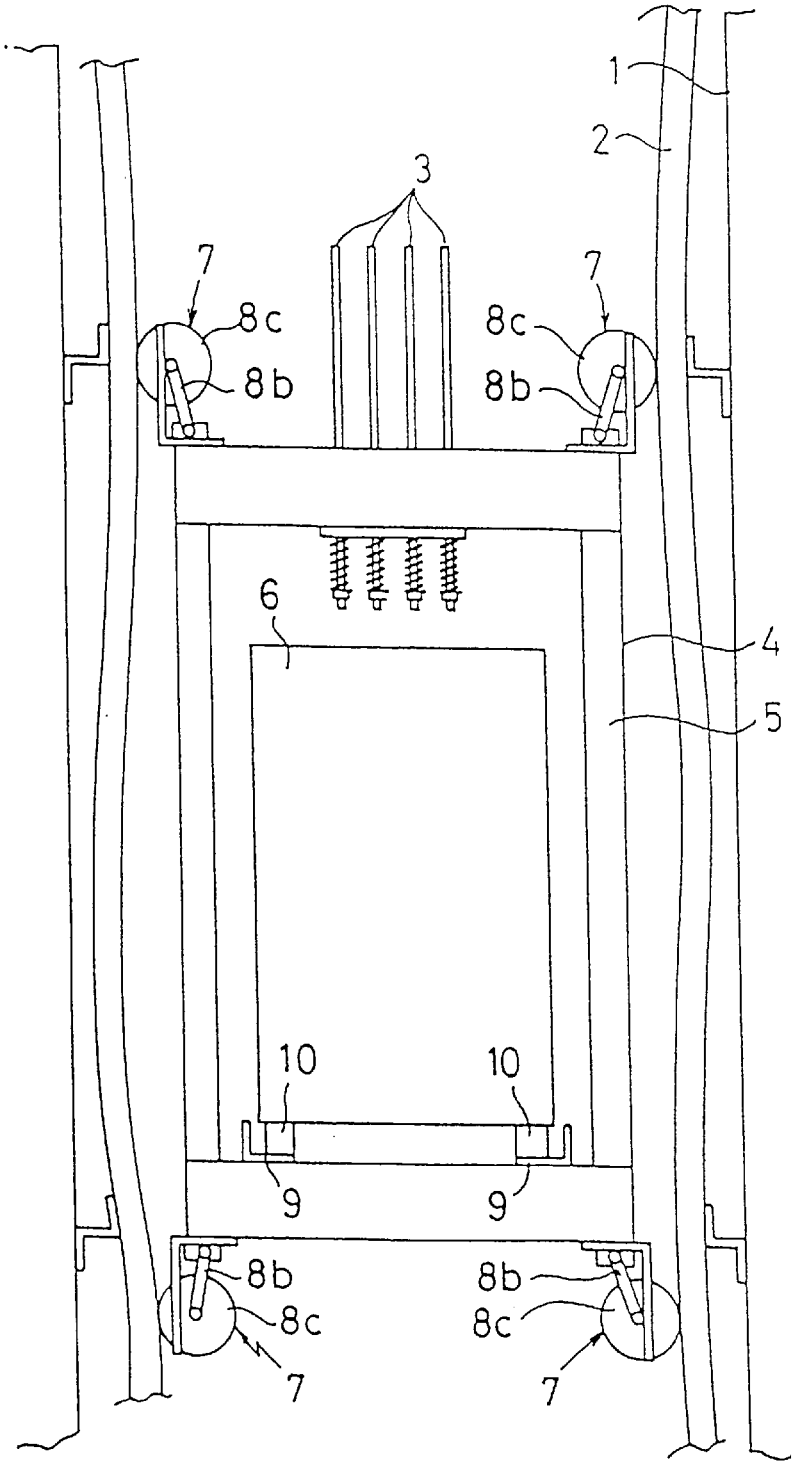
FIG. 16 is a schematic view showing a prior art.
Figure 17:
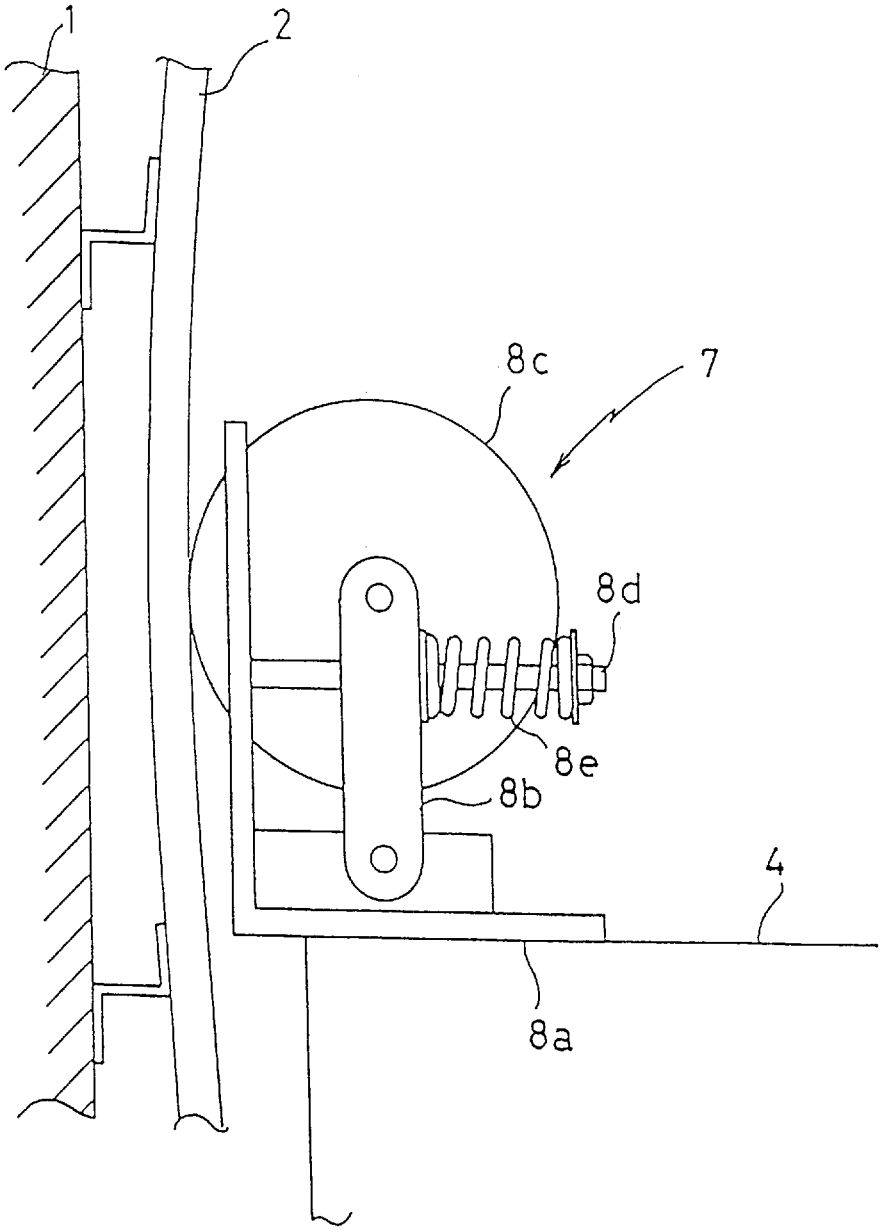
FIG. 17 is an enlarged view showing a guide unit of the prior art.

Embodiments of this invention will be explained in detail with reference to the drawings. FIG. 1 shows a vibration control apparatus for a first elevator according to an embodiment of the invention. Many parts of this embodiment are the same as those of the prior art of FIGS. 16 and 17. These parts are represented with like reference marks and are not explained again. This embodiment is characterized by a guide unit 7 whose details are shown in FIG. 2, a controller 12 for controlling the guide unit 7, and an acceleration sensor 11 for detecting vibration of a passenger car 4.

Four guide units 7 are arranged at left and right corners on the top and bottom of the passenger car, to guide a passenger car frame 5 upwardly or downwardly along a pair of guide rails 2 vertically installed in an elevator passage 1 of a building. A passenger car chamber 6 is supported by the passenger car frame 5 through floor support frames 9 and rubber dampers 10. The passenger car 4 is hoisted up or down by hoist cables 3. The guide rails 2 involve curves and level differences at joints due to installation errors, etc. When the passenger car 4 passes over the curves and level differences of the guide rails, it is forcibly displaced to cause transverse vibration. The acceleration sensor 11 attached to the passenger car chamber 6 detects the transverse vibration. The controller 12 calculates an operation quantity necessary for attenuating the transverse vibration. According to the calculated operation quantity, a piezoelectric element 8*f* serving as an actuator of the guide unit 7 of FIG. 2 and a presser spring 8*e* apply force to the passenger car 4.

Figure 2:
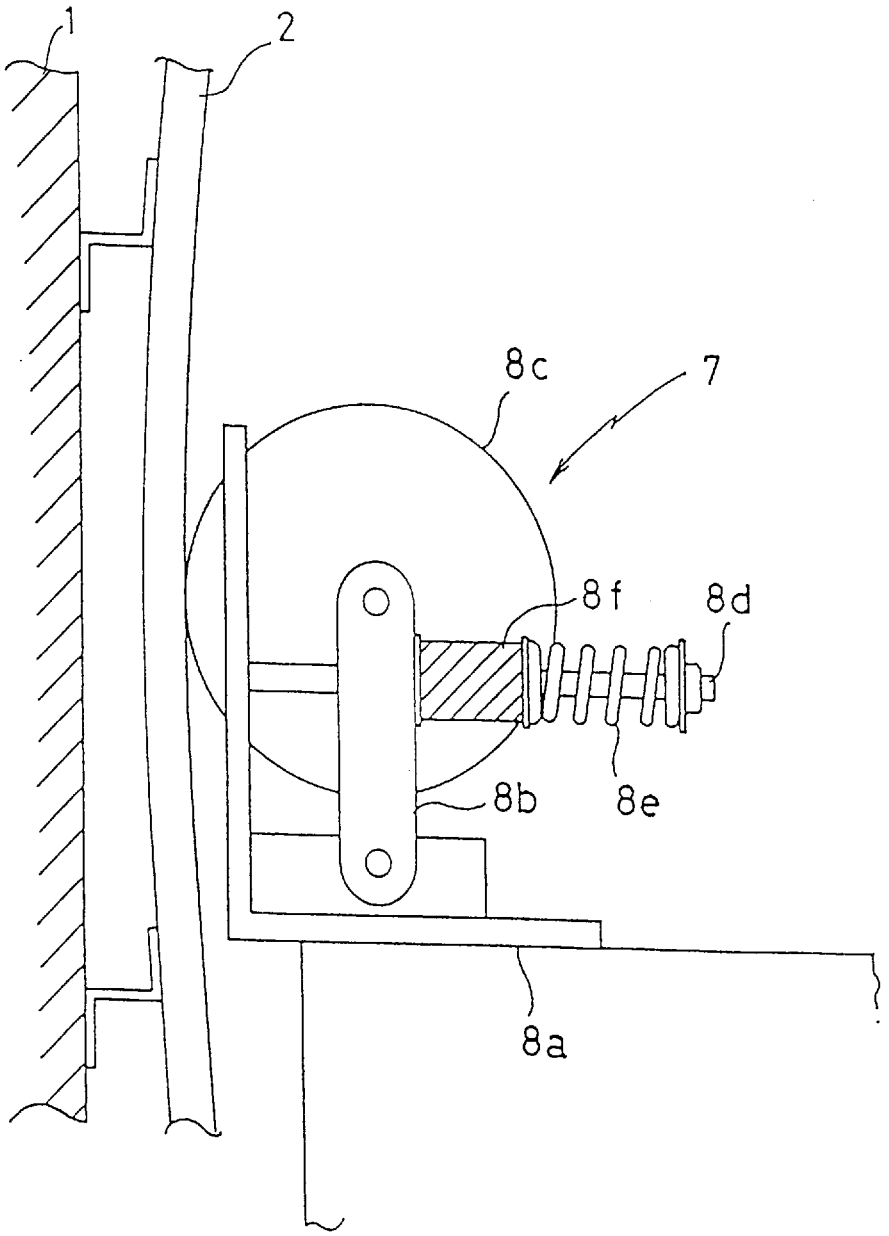
FIG. 2 is a schematic view showing an actuator of the above embodiment.

The guide unit 7 of FIG. 2 consists of a guide base 8*a* fixed to the passenger car frame 5, a lever 8*b* rotatably attached to the guide base, a guide roller 8*c* rotatably attached to the other end of the lever 8*b*, a rod 8*d* having an end fixed to the guide base 8*a*, the presser spring 8*e*, and the piezoelectric element 8*f*, i.e., the actuator. The presser spring and piezoelectric element are arranged between the rod 8*d* and the lever 8*b*, to suppress a displacement of the guide roller 8*c*. The guide roller 8*c* rolls along the side and end faces of the guide rail 2.

Figure 3:
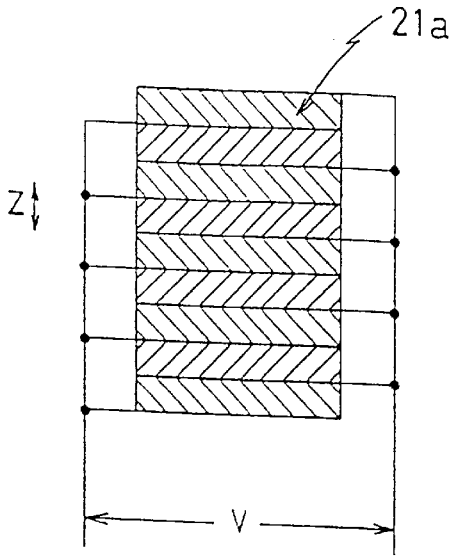
FIG. 3 is a sectional view showing the structure of a piezoelectric element of the actuator of the above embodiment.

As shown in FIG. 3, the piezoelectric element 8*f*, i.e., the actuator consists of laminated plate elements 21*a*. Each of the elements 21*a* produces a small displacement of about 0.1 mm, but the laminated structure as a whole provides a large displacement. To enlarge a displacement of the piezoelectric element 8*f*, the lever 8*b* is interposed. This arrangement transfers a sufficient displacement to the passenger car 4.

Figure 4:
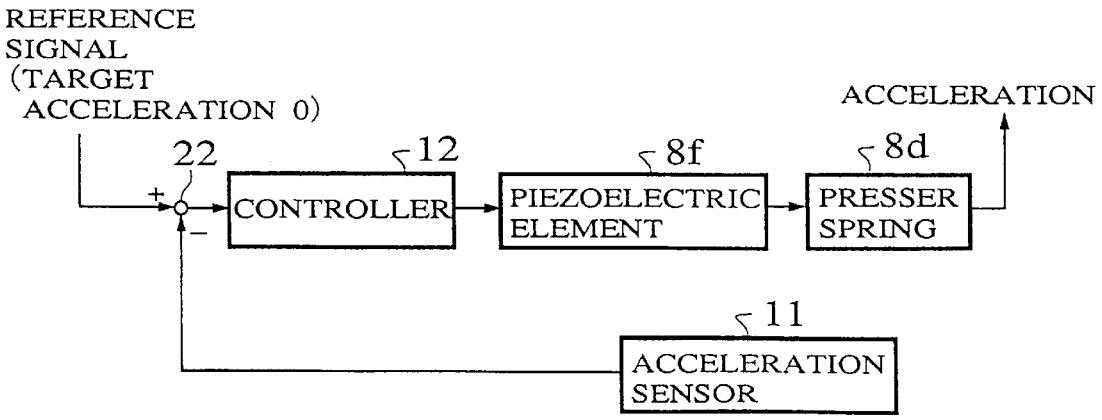
FIG. 4 is a block diagram showing a circuit of the above embodiment.

FIG. 4 shows an electric control system. An adder 22 provides a deviation of an acceleration signal of the acceleration sensor 11 from a reference acceleration signal, i.e., a target acceleration signal. The deviation is supplied to the controller 12, which calculates a required displacement and sends a voltage signal corresponding to the required displacement to the piezoelectric element 8*f*. The piezoelectric element 8*f* carries out a piezoelectric action to convert the input voltage into a displacement, which is enlarged by the presser spring 8*e* and given to the lever 8*b*. The lever 8*b* displaces the guide roller 8*c* accordingly.

The operation of the elevator vibration control apparatus of the above configuration will be explained. Level differences at the joints of and curves in the guide rails 2 vibrate the passenger car 4. The acceleration sensor 11 on the passenger car 4 provides a signal representing the vibration.

The signal is processed by the controller 12, which provides the piezoelectric element 8*f*, i.e., the actuator with a voltage corresponding to a required displacement. The piezoelectric element 8*f* converts the voltage into a displacement, which is given to the presser spring 8*e* and is enlarged by the lever 8*b*. As a result, force to cancel the acceleration of the passenger car 4 is applied to the passenger car 4. Consequently, the acceleration of the passenger car 4 is zeroed, to thereby stop the passenger car 4 from transversely vibrating.

When the elevator is stopped at a requested floor, the displacement of the piezoelectric element 8*f*, i.e., the actuator is returned to a reference value, and then, the elevator is hoisted up or down. If the actuator keeps the displacement, no damping action will be achieved.

In this way, the elevator vibration control apparatus of this embodiment actively suppresses transverse vibration of the passenger car, to improve comfortableness of the elevator. The acceleration sensor is easily attached to the passenger car. The piezoelectric element, i.e., the actuator is light, and therefore, the vibration control apparatus of this invention is easily added to a conventional elevator.

Figure 5:
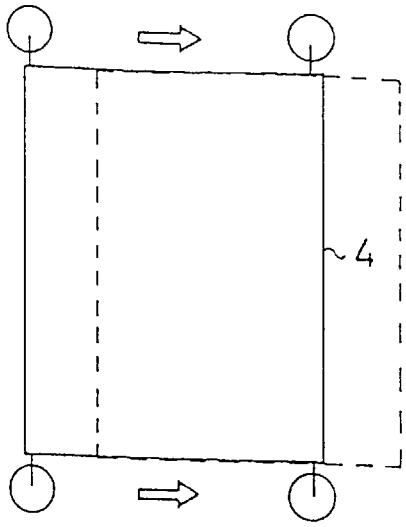
FIGS. 5A–B Are a view explaining a vibration damping action of the above embodiment.
Figure 5:
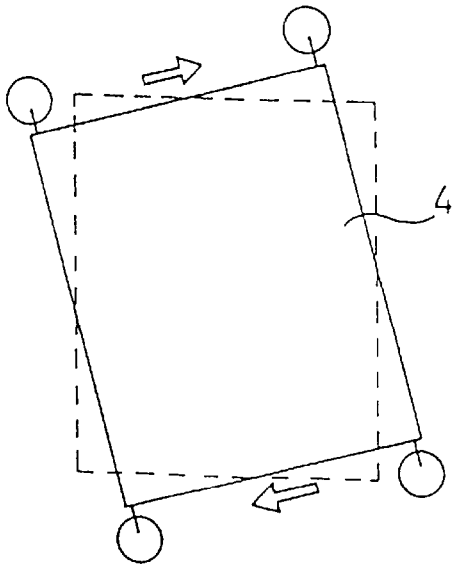

The elevator vibration control apparatus according to the invention is not limited to the above embodiment. The above embodiment achieves a damping action against transverse acceleration as shown in FIG. 5A. It is possible to attach one or more angular acceleration sensors to the passenger car. The controller processes angular acceleration detected by the angular acceleration sensors and provides a voltage signal to displace the piezoelectric element, i.e., the actuator to cancel the detected angular acceleration. This arrangement is capable of damping rotational vibration of the passenger car as shown in FIG. 5B, to further improve comfortableness of the elevator.

The first embodiment of the invention arranges the actuator 8*f* only for the guide unit 7 on the top of the passenger car 4. This embodiment does not limit the invention. A second embodiment according to the invention arranges the piezoelectric element 8*f*, i.e., the actuator of the vibration control apparatus on each of the top and bottom of the passenger car 4. The acceleration sensor 11 is also arranged at a proper location on each of the top and bottom of the passenger car 4. According to acceleration signals from the top and bottom acceleration sensors 11, the controllers 12 control voltages applied to the top and bottom piezoelectric elements 8*f*.

In this embodiment, the top and bottom acceleration sensors 11 detect transverse vibration at the top and bottom of the passenger car 4. According to the detected vibration, the top and bottom controllers 12 control displacements of the top and bottom piezoelectric elements 8*f*, to cancel the vibration acceleration at the top and bottom of the passenger car. Namely, the controllers 12 send control signals to the top and bottom piezoelectric elements 8*f*, i.e., the actuators, which displace the top and bottom of the passenger car 4. In this way, transverse vibration of the passenger car 4 is more effectively reduced, and comfortableness of riding in the passenger car is improved.

Figure 6:
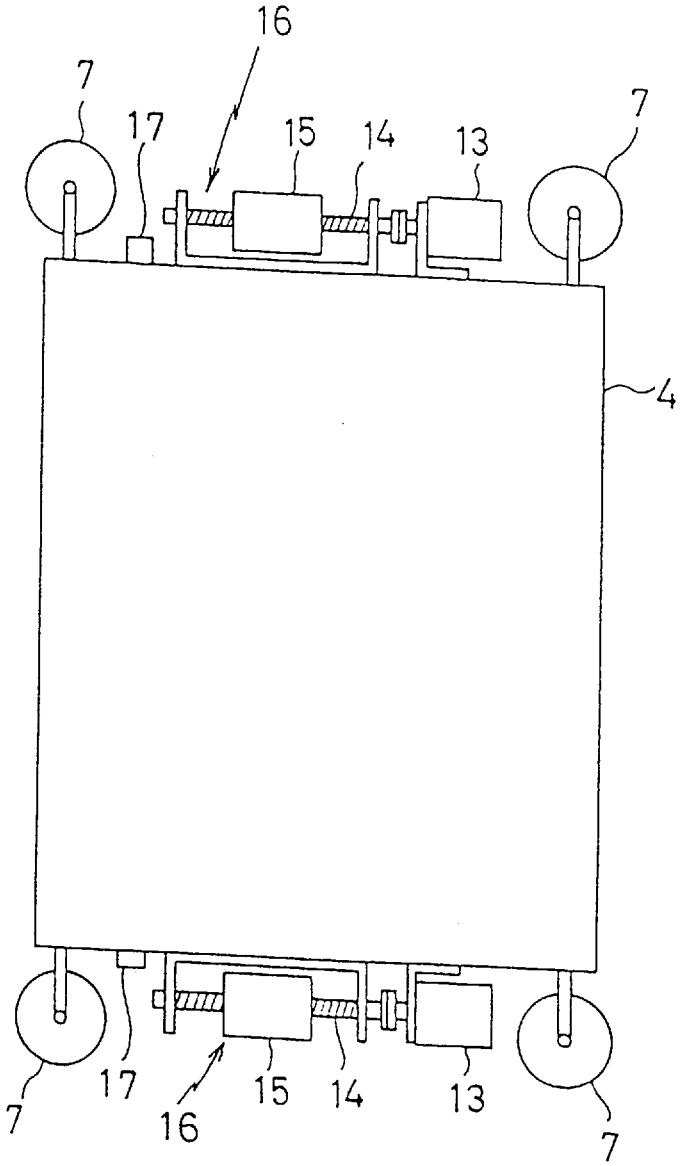
FIG. 6 is a schematic view showing a fourth embodiment of the invention.
Figure 7:
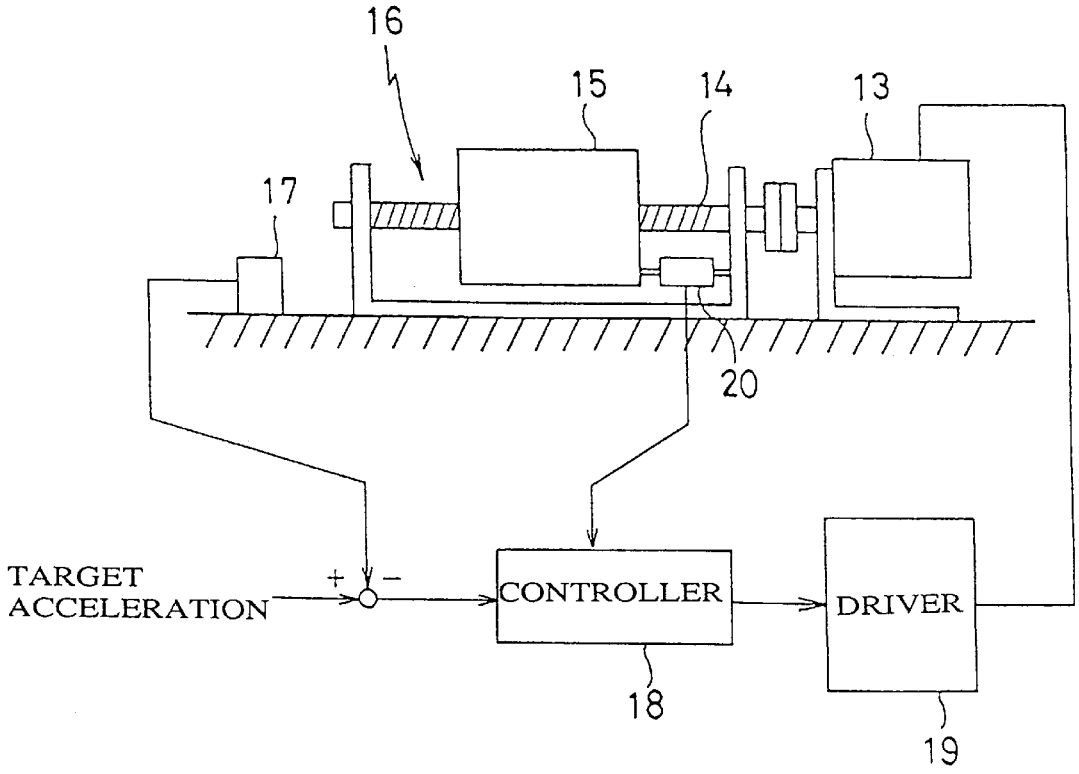
FIG. 7 is a block diagram showing a circuit of the above embodiment.

A vibration control apparatus for an elevator according to a fourth embodiment of the invention will be explained with reference to FIGS. 6 and 7. Each of the top and bottom of a passenger car 4 is provided with an actuator 16 including a servomotor 13, a translation mechanism 14, and a weight 15 linearly moved thereby, a vibration sensor 17 arranged on the passenger car 4 in the vicinity of the actuator 16, a controller 18 for calculating a driving quantity of the servomotor 13 according to vibration detected by the vibration sensor 17, to produce inertial force to cancel the detected vibration, and a driver 19 for driving the servomotor 13. Numeral 20 is a position sensor for the weight 15.

In the elevator vibration control apparatus of this arrangement, the vibration sensors 17 detect transverse vibration of the passenger car 4 caused by level differences of joints of and curves in the guide rails in the elevator passage of FIG. 1 and provide acceleration signals representing the detected vibration. A deviation of each of the acceleration signals from a reference acceleration signal, i.e., a target acceleration signal is found, and according to the deviations, the controllers 18 calculate driving quantities of the servomotors to produce opposing inertial force to cancel the transverse vibration. According to the calculated driving quantities, the drivers 19 drive the servomotors 13 in a forward or reverse direction, to let the translation mechanisms 14 linearly move the weights 15 through threads in a direction to cancel the transverse vibration. As a result, the transverse vibration of the passenger car 4 is suppressed.

As shown in FIGS. 5A–B, the passenger car 4 causes translational vibration and rotational vibration. The translational vibration of FIG. 5A is suppressed when the top and bottom controllers 18 move the weights 15 in the same direction. When the passenger car 4 causes the rotational vibration of FIG. 5B, the top and bottom vibration sensors 17 detect vibrations of opposite phases. As a result, the top and bottom controllers 18 move the weights 15 in opposite directions, to suppress the rotational vibration.

In this way, the elevator vibration control apparatus of this embodiment suppresses transverse vibration of the passenger car of the elevator by moving the weights in a direction to cancel the transverse vibration. Then, the weights produce inertial force to suppress the transverse vibration, thereby improving comfortableness of riding in the elevator.

Figure 8:
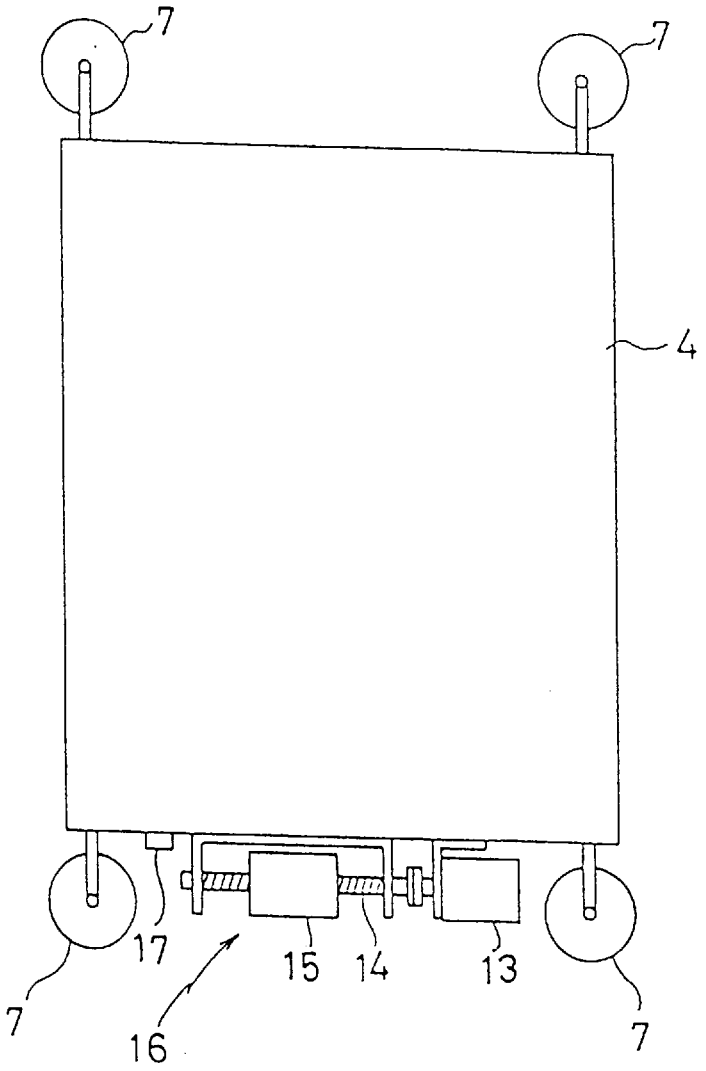
FIG. 8 is a schematic view showing a third embodiment of the invention.

FIG. 8 shows a third embodiment of the invention of. Unlike the preceding embodiment, this embodiment arranges an elevator vibration control apparatus only on the bottom or top of a passenger car 4. Arranging the vibration control apparatus on the bottom of the passenger car 4 is advantageous because the bottom of the passenger car 4 has a large installation space and because operation noise of the vibration control apparatus is far from and insensitive to the ears of persons in the passenger car 4.

Figure 9:
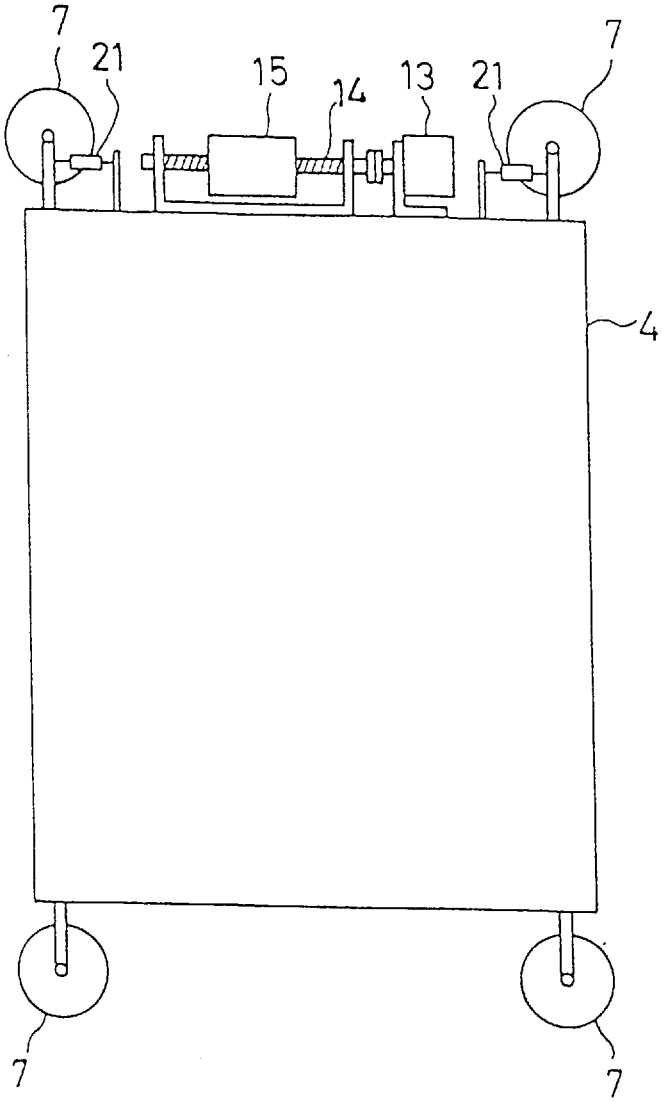
FIG. 9 is a schematic view showing a fifth embodiment of the invention.
Figure 10:
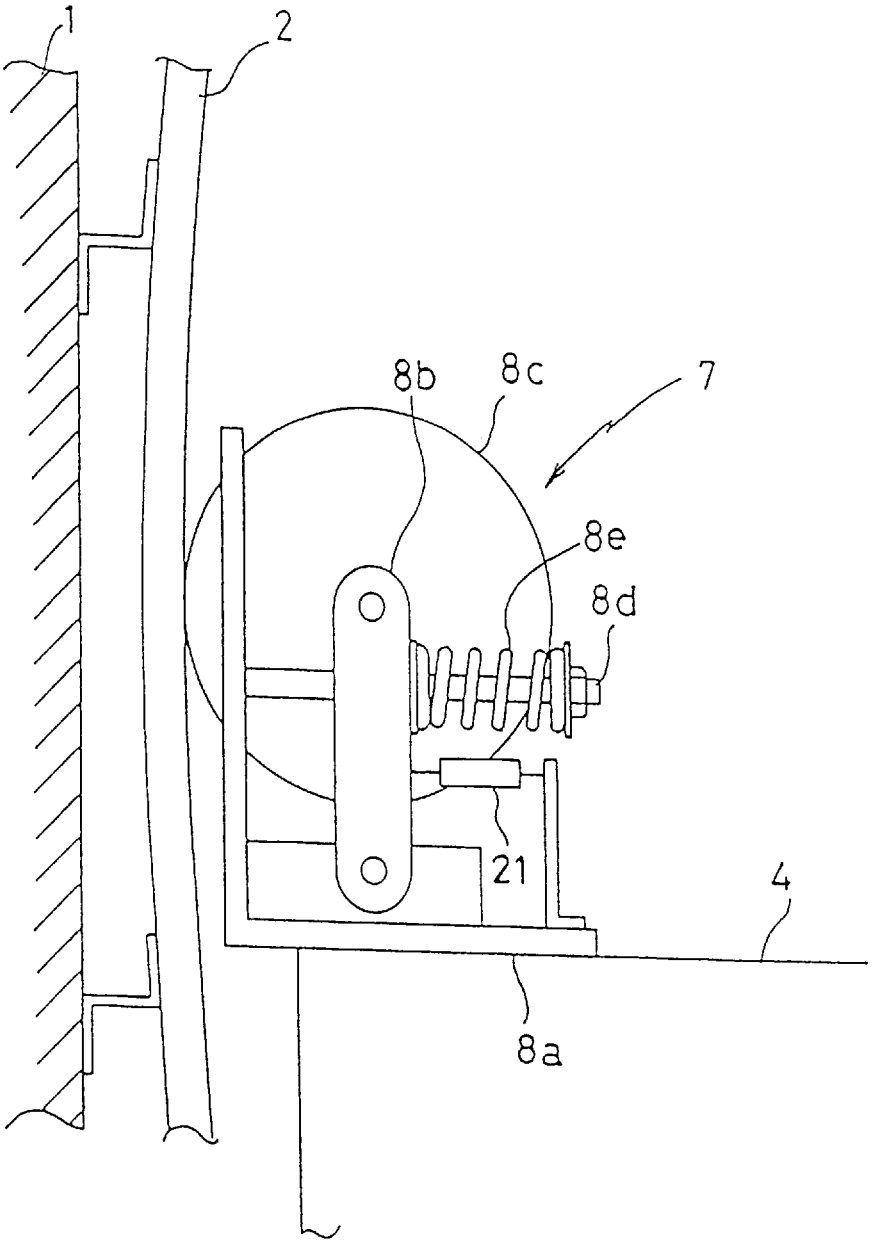
FIG. 10 is an enlarged view showing the structure of a displacement sensor of the above embodiment.

An elevator vibration control apparatus according to fifth and seventh embodiments will be explained with reference to FIGS. 9 to 11. Many parts of the elevator vibration control apparatus of this embodiment are the same as those of the prior art of FIGS. 16 and 17. These parts are represented with like reference marks and are not explained again. The same parts as those of the embodiments of FIGS. 1 to 8 are also represented with like reference marks and are not explained again.

The elevator vibration control apparatus of this embodiment provides the top of a passenger car 4 with a servomotor 13, a translation mechanism 14 driven by the servomotor, for converting rotational motion into linear motion, a weight 15 to be linearly moved by the translation mechanism 14, and a displacement sensor 21 attached to each of left and right guide units 7. An enlarged view of the guide unit 7 is shown in FIG. 10. The guide unit 7 has a guide base 8*a*, a rocking lever 8*b* having one end attached to the guide base 8*a*, a guide roller 8*c* rotatably attached to the other end of the lever 8*b*, to roll along a guide rail 2 installed in an elevator passage 1, a rod 8*d* having one end fixed to the guide base 8*a*, and a spring 8*e* attached to the rod 8*d*. The spring 8*e* presses the lever 8*b* against the guide rail 2, so that the guide roller 8*c* may be pressed against the guide rail 2 and roll along the guide rail 2.

The displacement sensor 21 is arranged between the guide base 8*a* and the lever 8*b* of each of the left and right guide units 8, to detect a displacement of the lever 8*b* relative to the passenger car 4. The displacement sensor 21 may be a potentiometer to provide a voltage signal corresponding to a displacement of a contact from the lever 8*b*. The voltage signal is used as a displacement signal.

Figure 11:
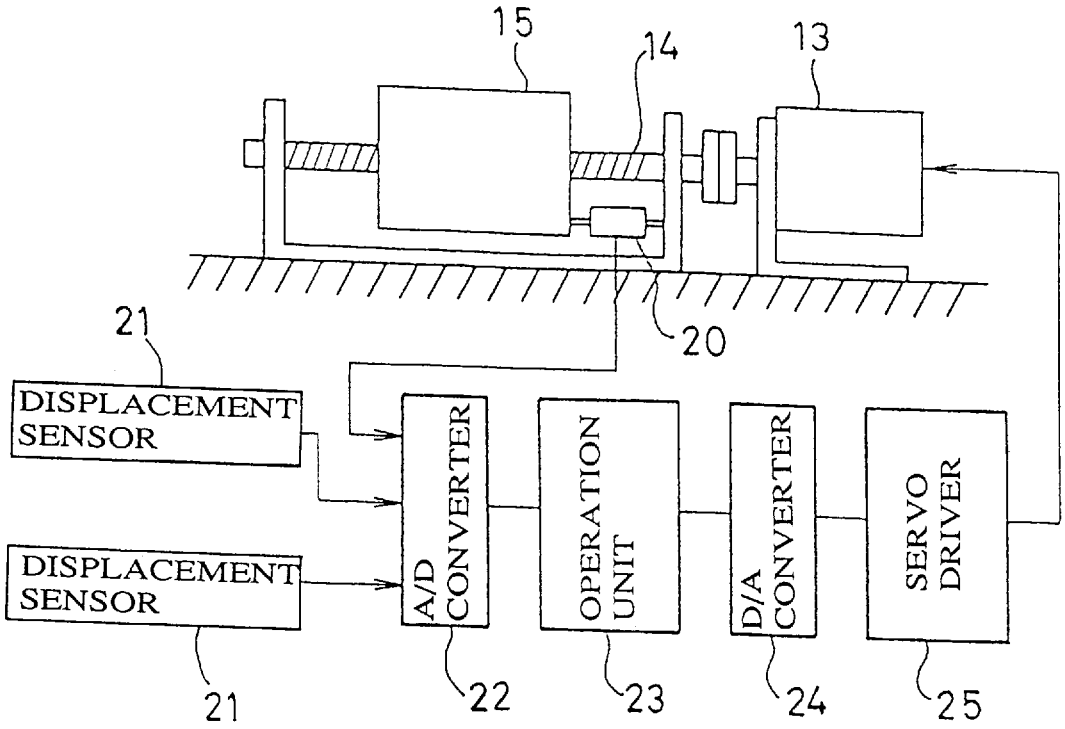
FIG. 11 is a block diagram showing a circuit according to a sixth embodiment of the invention.

FIG. 11 shows an arrangement of the elevator vibration control apparatus of this embodiment. The apparatus includes an A/D converter 22 for converting displacement signals from the left and right displacement sensors 21 into digital signals, an operation unit 23 for calculating a weighted average of left and right displacements according to the displacement digital signals provided by the A/D converter 22, the weighted average being used to find a shift of the weight 15 to attenuate transverse vibration of the passenger car 4 as well as a driving quantity of the servomotor 13 corresponding to the shift of the weight, a D/A converter 24 for converting the servomotor driving digital signal into an analog signal, and a servo driver 25 for driving the servomotor 13 according to the signal provided by the D/A converter 24.

When the elevator is stopped at a requested floor, the weight 15 of the translation mechanism 14 must be returned to an initial position. For this purpose, the translation mechanism 14 has a sensor 20 for detecting the position of the weight 15. A signal from the position sensor 20 is supplied to the operation unit 23 through the A/D converter 22. The operation unit 23 calculates a positional deviation of the weight 15, finds out a driving quantity of the servomotor 13 to return the weight to the initial position, and provides the driving quantity to the servo driver 25.

An operation of the elevator vibration control apparatus of the above arrangement will be explained. When the passenger car 4 of the elevator is hoisted up or down along the guide rails 2, curves in the guide rails 2 and level differences at joints of the guide rails 2 may vibrate the passenger car 4. Due to a displacement relative to the guide rails 2, the lever 8*b* and guide roller 8*c* pushed by the spring 8*e* of the guide unit 7 are transversely displaced with respect to the guide base 8*a*. The relative displacement is detected by each of the displacement sensors 21 and is supplied to the operation unit 23 through the A/D converter 22.

The operation unit 23 calculates a weighted average of the displacement signals from the left and right displacement sensors 21. When the right displacement sensor 21 detects a displacement Xr(t) and the left displacement sensor 21 detects a displacement Xl(t), a displacement X(t) of the passenger car 4 is calculated as follows:

$$X(t)=(Xr(t)+Xl(t))/2 \tag{1}$$

With the mass of the weight 15 of the translation mechanism 14 being M, a lead (a distance moved by the weight 15 when the shaft of the translation mechanism turns once) being γ, and a rotational angle velocity of the servomotor 13 being Ω(t), the operation unit 23 calculates inertial force F(t) to be produced by the weight 15 as follows:

$$F(t)=\gamma/2\pi\cdot M\cdot d\Omega(t)/dt \tag{2}$$

When the operation unit 23 and servo driver 25 provide the angular velocity Ω(t) of the servomotor 13 in proportion to the displacement X(t), the following is established:

$$\Omega(t)=k\cdot X(t) \tag{3}$$

Then, the inertial force F(t) is as follows:

$$F(t)=\gamma/2\pi\cdot kM\cdot dX(t)/dt \tag{4}$$

Namely, the inertial force is determined by the displacement X(t). Here, k is a proportional gain.

According to the expression (4), the inertial force F(t) is provided by a temporal differentiation of the displacement X(t), i.e., in proportion to the velocity. The operation unit 23 calculates the displacement X(t), temporally differentiates the displacement X(t), multiplies the result by the proportional gain k that is experimentally obtained, and provides the servo driver 25 with an angular velocity instruction Ω(t). As a result, the weight 15 is moved to produce the inertial force corresponding to transverse vibration of the passenger car 4, to thereby effectively attenuate the transverse vibration of the passenger car 4.

The invention of the fifth embodiment has other variations. The vibration control apparatus mentioned above may be arranged only on the bottom of the passenger car 4. The above embodiment calculates a weighted average of signals from the left and right displacement sensors 21. Instead, the displacement sensor may be arranged on one side, or at the center.

A sixth embodiment according to the invention will be explained with reference to FIG. 12. This embodiment arranges the vibration control apparatus of FIGS. 9 and 10 on each of the top and bottom of a passenger car 4. Namely, this embodiment provides each of the top and bottom of the passenger car 4 with a servomotor 13, a translation mechanism 14 driven by the servomotor, for converting rotational motion into linear motion, a weight 15 to be linearly moved by the translation mechanism 14, and a displacement sensor 21 provided for each of left and right guide units 7.

A circuit of each of the top and bottom vibration control apparatuses is the same as that of FIG. 11. Namely, each of the vibration control apparatuses has an A/D converter 22 for converting displacement signals from the left and right displacement sensors 21 into digital signals, an operation unit 23 for calculating a weighted average of left and right displacements according to the digital signals, the weighted average being used to find a shift of the weight 15 to attenuate transverse vibration of the passenger car 4 as well as a driving quantity of the servomotor 13 corresponding to the shift of the weight, a D/A converter 24 for converting a servomotor driving digital instruction signal provided by the operation unit 23 into an analog signal, and a servo driver 25 for driving the servomotor 13 according to the signal from the D/A converter 24.

Figure 12:
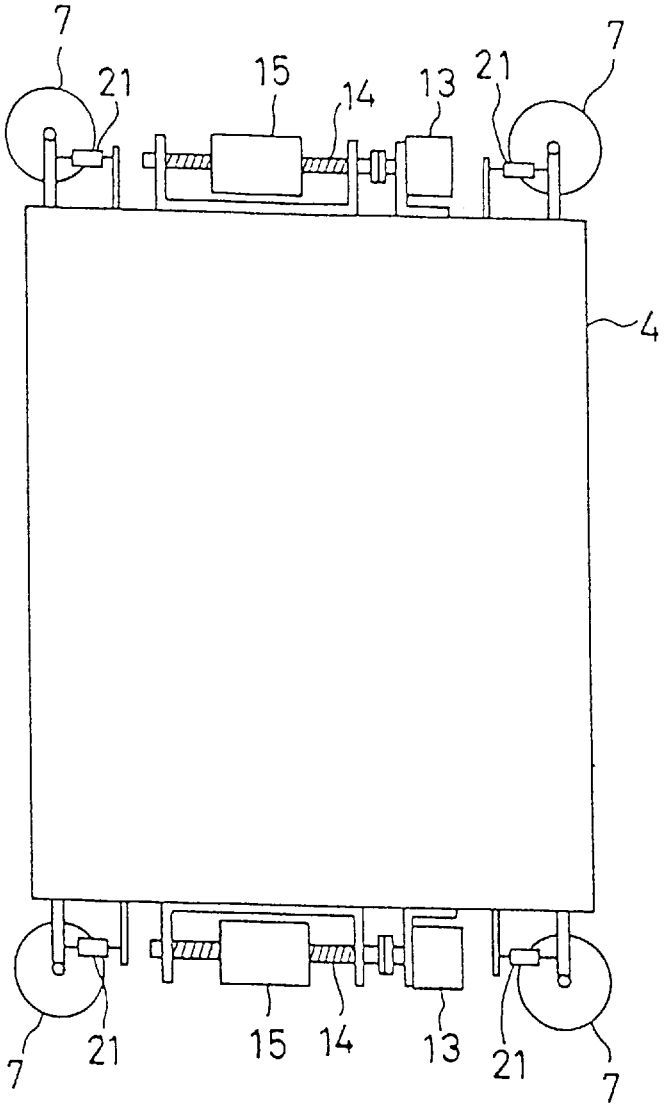
FIG. 12 is a schematic view showing a seventh embodiment of the invention.

According to the embodiment of FIG. 12, the top vibration control apparatus attenuates vibration at the top of the passenger car 4, and the bottom vibration control apparatus attenuates vibration at the bottom of the passenger car 4. In this way, this embodiment separately attenuates transverse vibration at the top and bottom of the passenger car 4, to effectively reduce transverse vibration of the passenger car 4 and more effectively improve comfortableness of riding in the passenger car.

Figure 13:
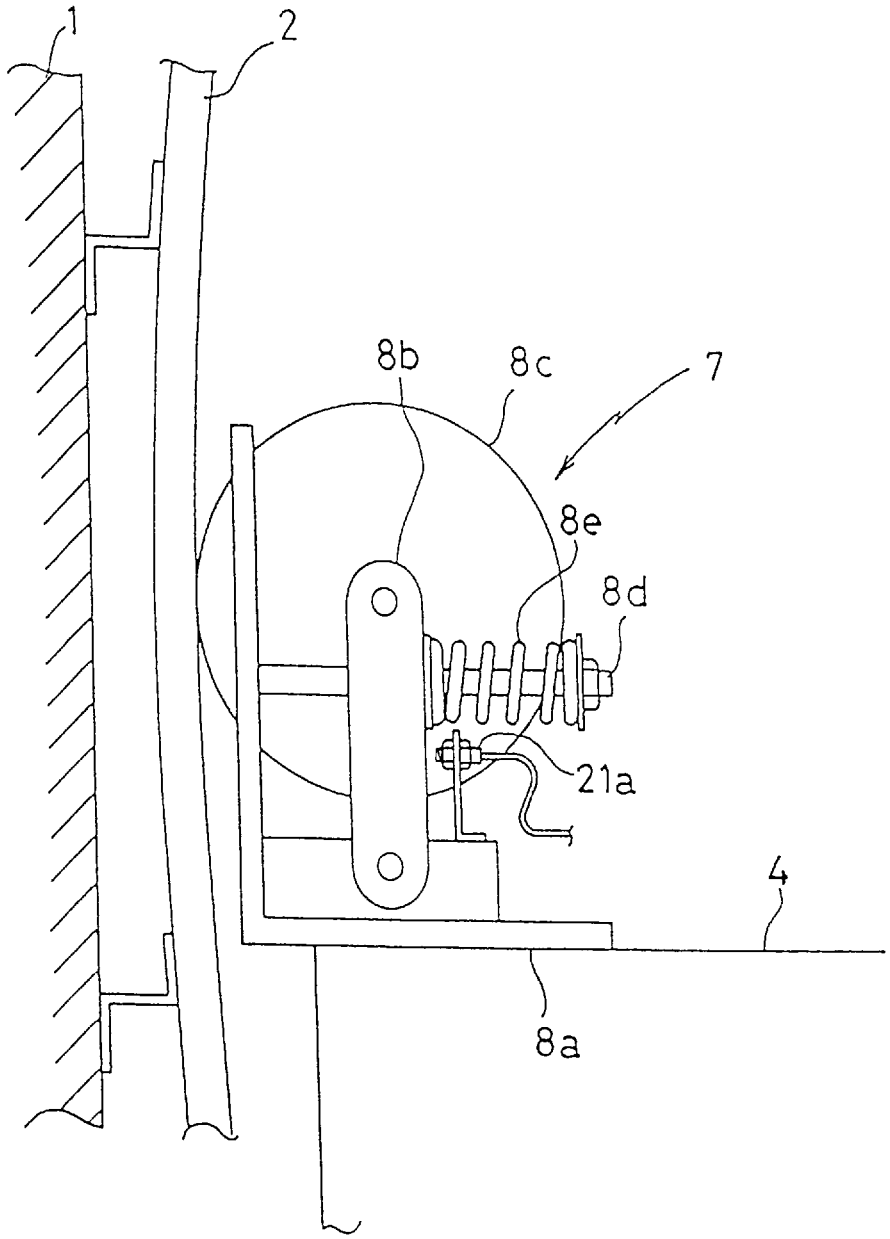
FIG. 13 is a schematic view showing an eighth embodiment of the invention.

FIG. 13 shows an eighth embodiment of an elevator vibration control apparatus. This embodiment provides a displacement sensor adoptable for the elevator vibration control apparatuses of the inventions of the fifth through seventh embodiments. The displacement sensor of FIG. 13 is a distance sensor 21*a* for detecting a displacement of a passenger car 4. The distance sensor 21*a* may be an ultrasonic sensor or a photoelectric sensor attached to a guide base 8*a* fixed to the passenger car 4. The distance sensor 21*a* detects a distance up to a lever 8*b* that is pushed by a spring 8*e*. The spring 8*e* presses a guide roller 8*c* against a guide rail 2 so that the guide roller 8*c* rolls along the guide rail 2. A signal representing the detected distance is used to calculate a transverse displacement of the passenger car 4.

The distance signal from the distance sensor 21*a* is supplied to the operation unit 23 of FIG. 11, which temporally differentiates the signal to find a displacement X(t) of the passenger car 4. According to the displacement X(t) and the expressions (1) to (4) mentioned above, an angular velocity Ω(t) of the servomotor 13 is obtained to control the rotation of the servomotor 13. Consequently, the weight 15 produces inertial force F(t) to attenuate transverse vibration of the passenger car 4 and improve comfortableness of riding in the passenger car.

Figure 14:
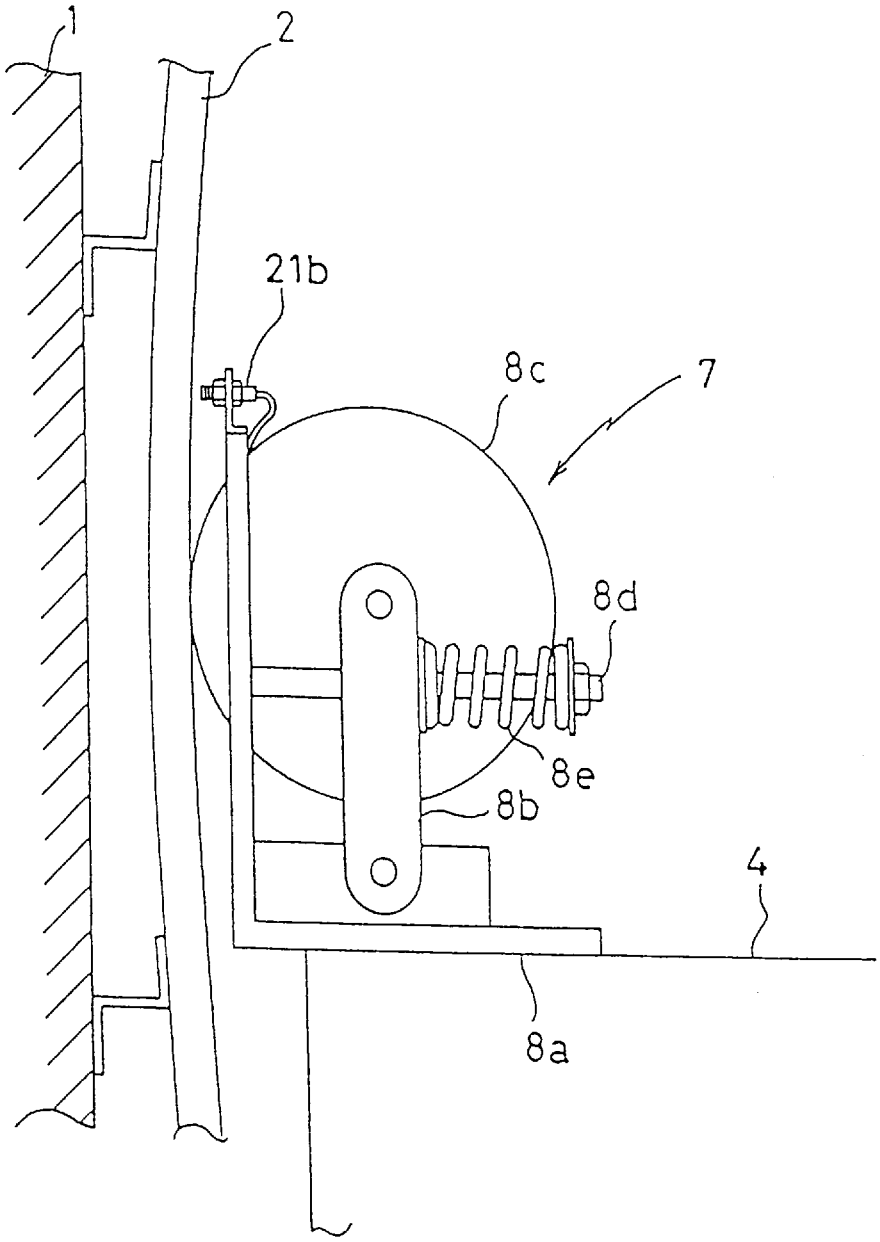
FIG. 14 is a schematic view showing an embodiment of the above invention.

FIG. 14 shows another displacement sensor according to an eighth embodiment of the invention. The displacement sensor of this embodiment is a noncontact-type distance sensor 21*b* attached to a guide base 8*a* of a guide unit 7, to detect a transverse displacement of a passenger car 4. The distance sensor 21b detects a distance up to a guide rail 2 and provides a 10 distance signal, which is temporally differentiated to find a displacement of the passenger car 4.

Similar to the embodiment of FIG. 13, the distance sensor 21*b* of this embodiment provides the operation unit 23 of the circuit of FIG. 11 with the distance signal. The operation unit 23 temporally differentiates the signal, to find a displacement X(t) of the passenger car 4. The displacement X(t) is used to calculate an angular velocity Ω(t) of the servomotor 13 according to the expressions (1) to (4). The rotation of the servomotor 13 is controlled accordingly, to attenuate transverse vibration of the passenger car 4 by inertial force F(t) of the weight 15. As a result, comfortableness of the elevator is improved.

Figure 15:
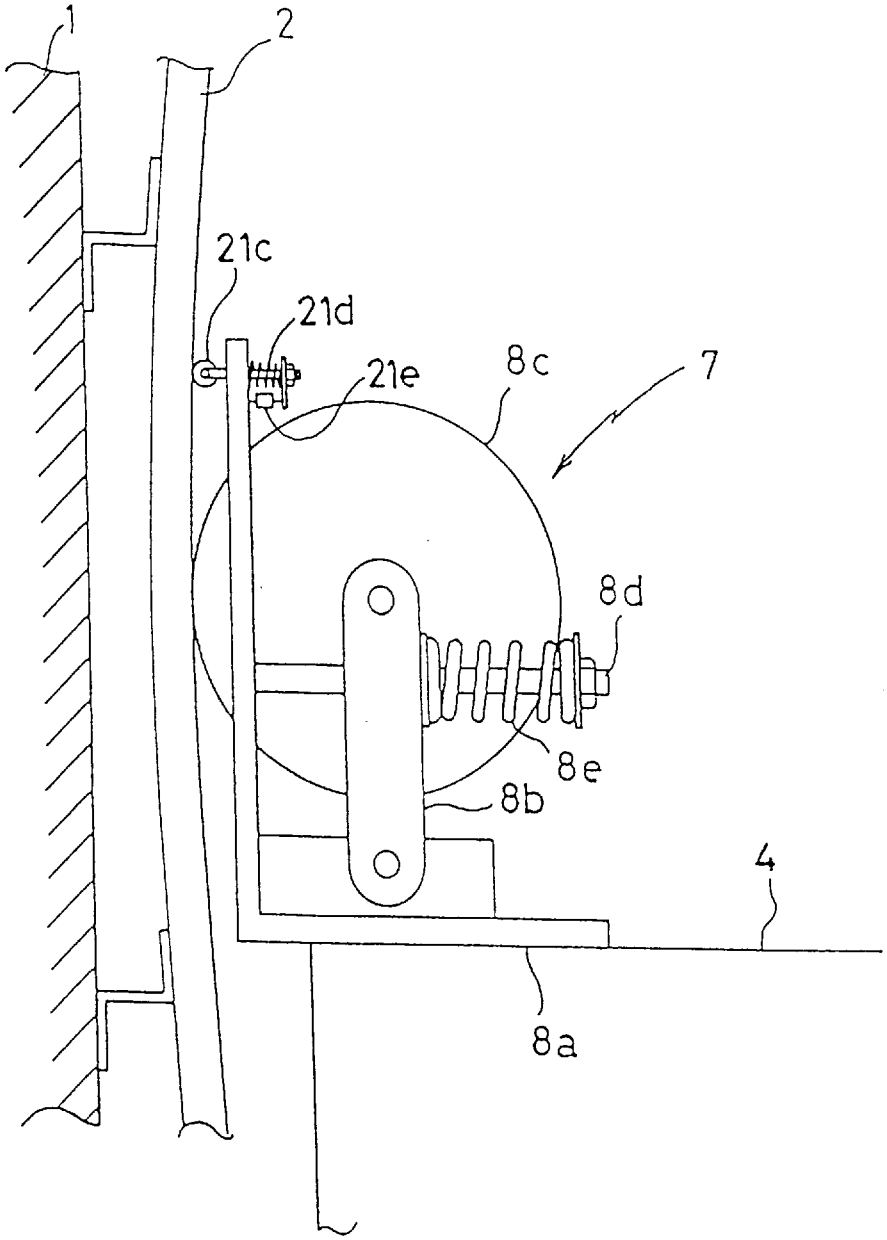
FIG. 15 is a schematic view showing a ninth embodiment of the invention.

FIG. 15 shows a ninth embodiment of the invention of. A roller 21*c* is movably attached to a passenger car 4. The roller 21*c* is pressed against a guide rail 2 by a spring 21*d*. The roller 21*c* is used to detect a displacement of the passenger car 4 according to a change in the distance between the passenger car 4 and the guide rail 2. In response to a displacement of the roller 21*c*, a displacement sensor 21*e* such as a potentiometer detects the displacement. The displacement sensor 21*e* provides a displacement signal, which is sent to the operation unit 23 of FIG. 11. Similar to the preceding embodiments, this embodiment controls the rotation of the servomotor 13 to let the weight 15 produce inertial force F(t) to attenuate transverse vibration of the passenger car 4, to improve comfortableness of the passenger car.

Industrial Applicability

As explained above, the invention of the first embodiment attaches an acceleration sensor to a passenger car of an elevator. According to a value detected by the acceleration sensor, a piezoelectric element serving as an actuator attached to a guide roller is displaced to apply force to the passenger car in a direction to cancel the detected acceleration. In this way, the invention suppresses transverse vibration of the passenger car by forcibly displacing the passenger car in an opposite phase, to thereby improve comfortableness of the elevator.

The invention of the second embodiment provides each of the top and bottom of a passenger car of an elevator with a vibration sensor to detect transverse vibration at the top and bottom of the passenger car. Top and bottom controllers calculate operation quantities of top and bottom actuators, to cancel vibration acceleration at the top and bottom of the passenger car. The calculated operation quantities are sent to the top and bottom actuators to displace multilayer piezoelectric elements of the top and bottom actuators. As a result, the top and bottom of the passenger car are displaced in a direction to attenuate the transverse vibration, to suppress force applied to the passenger car. This arrangement more effectively reduces transverse vibration of the passenger car and improves comfortableness of riding in the passenger car.

The invention of the third embodiment employs a vibration sensor for detecting vibration of a passenger car of an elevator and a controller for processing a signal from the vibration sensor. The controller drives a servomotor, which drives a translation mechanism. The translation mechanism linearly moves a weight so that the weight produces inertial force in a direction to cancel the vibration of the passenger car. The inertial force is applied to the passenger car, to attenuate the vibration of the passenger car and improve comfortableness of riding in the passenger car.

The invention of the fourth embodiment arranges a vibration sensor on each of the top and bottom of a passenger car of an elevator. The vibration sensors detect transverse vibration at the top and bottom of the passenger car. Signals from the top and bottom vibration sensors are processed by top and bottom controllers, which drive top and bottom servomotors. These servomotors drive top and bottom translation mechanisms accordingly, to linearly horizontally move top and bottom weights to produce inertial force in directions to attenuate the transverse vibration at the top and bottom of the passenger car. The inertial force is applied to the top and bottom of the passenger car, to attenuate the transverse vibration at the top and bottom of the passenger car, to thereby more effectively improve comfortableness of riding in the passenger car.

The invention of the fifth embodiment detects a displacement due to transverse vibration of a passenger car of an elevator. According to a signal representing the detected displacement, a driving quantity of a servomotor is calculated to let a translation mechanism horizontally move a weight for a distance to attenuate the transverse vibration of the passenger car due to a transverse displacement of a guide roller. According to the calculated driving quantity, the servomotor is driven to activate the translation mechanism, which moves the weight. The weight produces inertial force to attenuate the transverse vibration of the passenger car. Consequently, the transverse vibration of the passenger car is reduced to improve comfortableness of riding in the passenger car.

The invention of the sixth embodiment detects displacements at the top and bottom of a passenger car of an elevator, and according to signals representing the detected displacements, calculates driving quantities of top and bottom servomotors. These servomotors drive top and bottom translation mechanisms, which horizontally move top and bottom weights for distances to attenuate the transverse vibration at the top and bottom of the passenger car due to transverse displacements of guide rollers. In this way, the top and bottom servomotors are driven according to the calculated driving quantities to let the top and bottom translation mechanisms move the wights to apply inertial force to the passenger car, to thereby attenuate the transverse vibration at the top and bottom of the passenger car. As a result, the transverse vibration at the top and bottom of the passenger car are reduced to improve comfortableness of riding in the passenger car.

The invention of the seventh embodiment arranges two displacement detectors on left and right sides, respectively, on each or both of the top and bottom of a passenger car of an elevator. The left and right displacement detectors face each other. Displacement signals from the two displacement detectors are weighted and averaged into a normal displacement. Accordingly, a displacement at the top or bottom of the passenger car is correctly detected, and a movement of a weight corresponding to the displacement can be correctly calculated to effectively reduce transverse vibration of the passenger car and improve comfortableness of riding in the passenger car.

The invention of the eighth embodiment is based on the elevator vibration control apparatus of one of the fifth through seventh embodiments and employs a noncontact-type displacement detector for detecting a transverse displacement of a passenger car of an elevator relative to a guide rail.

The invention of the ninth embodiment is based on the elevator vibration control apparatus of one of claims 5 to 7 and employs a contact-type displacement detector attached to a passenger car of an elevator, to detect a transverse displacement of a guide roller when the guide roller rolls along a guide rail, to provide a signal representing a transverse displacement of the passenger car.

We claim:

1. In an elevator having guide rails installed in an elevator passage and a guide unit arranged on the top and bottom of a passenger car of the elevator, the guide unit having a rocking lever attached to the passenger car, a guide roller rotatably attached to the lever, and a spring for pressing the guide roller against the guide rail so that the guide roller may roll along the guide rail, a vibration control apparatus comprising a servomotor arranged on one of the top and bottom of the passenger car of the elevator, a translation mechanism driven by said servomotor, for converting rotational motion into linear motion, a weight to be linearly horizontally moved by said translation mechanism, a vibration sensor for detecting transverse vibration of the passenger car, and a controller for driving said servomotor according to a signal from said vibration sensor, to let said weight linearly horizontally move to produce inertial force in a direction to cancel the transverse vibration of the passenger car.

2. The elevator vibration control apparatus as set forth in claim 1, wherein each of the top and bottom of the passenger car of the elevator is provided with a servomotor, a translation mechanism driven by the servomotor, for converting rotational motion into linear motion, a weight to be linearly horizontally moved by the translation mechanism, a vibration sensor for detecting vibration of the passenger car, and a controller for driving the servomotor according to a signal from the vibration sensor, to let the weight linearly horizontally move to produce inertial force in a direction to cancel the transverse vibration of the passenger car.

3. In an elevator having guide rails installed in an elevator passage and a guide unit arranged on the top and bottom of a passenger car of the elevator, the guide unit having a rocking lever attached to the passenger car, a guide roller rotatably attached to the lever, and a spring for pressing the guide roller against the guide rail so that the guide roller may roll along the guide rail, a vibration control apparatus comprising a weight arranged on one of the top and bottom of the passenger car of the elevator, a translation mechanism for linearly horizontally move said weight, a servomotor for driving said translation mechanism, displacement detection means attached to the guide unit, for detecting a transverse displacement of the guide roller, an operation unit for calculating a driving quantity of said servomotor according to a signal from said displacement detection means, to let said translation mechanism horizontally move said weight for a distance to attenuate transverse vibration of the passenger car due to the transverse displacement of the guide roller, and a controller for driving said servomotor according to the driving quantity calculated by said operation unit.

4. The elevator vibration control apparatus as set forth in claim 3, wherein each of the top and bottom of the passenger car of the elevator is provided with a weight, a translation mechanism for linearly horizontally move the weight, a servomotor for driving the translation mechanism, displacement detection means attached to the guide unit, for detecting a transverse displacement of the guide roller, an operation unit for calculating a driving quantity of the servomotor according to a signal from the displacement detection means, to let the translation mechanism horizontally move the weight for a distance to attenuate transverse vibration of the passenger car due to the transverse displacement of the guide roller, and a controller for driving the servomotor according to the driving quantity calculated by the operation unit.

5. The elevator vibration control apparatus as set forth in claim 3, wherein said displacement detection means comprises two displacement sensors which are arranged on left and right sides of the passenger car, and said operation unit calculates a weighted average of displacement signals from the two displacement sensors and provides the weighted average.

6. The elevator vibration control apparatus as set forth in claim 3, wherein said displacement detection means is a noncontact-type detector for detecting a transverse displacement of the passenger car relative to the guide rail.

7. The elevator vibration control apparatus as set forth in claim, 3 wherein said displacement detection means is a contact-type displacement detector attached to the passenger car, to detect a transverse displacement of the guide roller when the guide roller rolls along the guide rail and provide a signal representing a transverse displacement of the passenger car.

8. The elevator vibration control apparatus as set forth in claim 4, wherein said displacement detection means comprises two displacement sensors which are arranged on left and right sides of the passenger car, and said operation unit calculates a weighted average of displacement signals from the two displacement detection sensors and provides the weighted average.

9. The elevator vibration control apparatus as set forth in claim 6, wherein said displacement detection means is a noncontact-type displacement detector for detecting a transverse displacement of the passenger car relative to the guide rail.

10. The elevator vibration control apparatus as set forth in claim 5, wherein said displacement detection sensors are noncontact-type sensors for detecting a transverse displacement of the passenger car relative to the guide rail.

11. The elevator vibration control apparatus as set forth ir claim 4, wherein said displacement detection means is a contact-type displacement detector attached to the passenger car, to detect a transverse displacement of the guide roller when the guide roller rolls along the guide rail and provide a signal representing a transverse displacement of the passenger car.

12. The elevator vibration control apparatus as set forth in claim 5, wherein said displacement detection sensors are contact-type sensors attached to the passenger car, to detect a transverse displacement of the guide roller when the guide roller rolls along the guide rail and provide a signal representing a transverse displacement of the passenger car.

* * * * *